United States Patent [19]

Assmann

[11] Patent Number: 4,781,118

[45] Date of Patent: Nov. 1, 1988

[54] GRENADE BODY, IN PARTICULAR FOR HAND GRENADES

[75] Inventor: Hans Assmann, Schwanenstadt-Kaufing, Austria

[73] Assignee: Oregon Establissement fur Patentverwertung, Liechtenstein

[21] Appl. No.: 834,000

[22] Filed: Feb. 27, 1986

[30] Foreign Application Priority Data

Mar. 4, 1985 [AT] Austria ..... 630/85
Jun. 19, 1985 [AT] Austria ..... 1814/85

[51] Int. Cl.[4] ..... F42B 27/00
[52] U.S. Cl. ..... 102/496; 102/482
[58] Field of Search ..... 102/389, 482, 491–497

[56] References Cited

U.S. PATENT DOCUMENTS 1,154,437 9/1915 Rimailho ..... 102/496
3,493,142 2/1970 Assmann ..... 102/482

FOREIGN PATENT DOCUMENTS 240218 5/1965 Austria .
348898 3/1979 Austria .

*Primary Examiner*—Harold Tudor
*Attorney, Agent, or Firm*—Lorusso & Loud

[57] ABSTRACT

A grenade body, in particular for hand grenades, comprising a muti-part fragmentation body which forms a hollow body and which comprises metal particles (7) embedded in plastics material, and an outer casing of plastics material which encloses the fragmentation body, wherein the parts (1, 2) of the fragmentation body interengage positively at the connecting surfaces (6). The preferably substantially spherical metal particles (7) project with only a small distance beyond the connecting surface (6) when the fragmentation body is assembled. In the region of the conecting surfaces (6), the inner layer of particles is displaced relative to the outer layer of particles by approximately half a particle diameter (FIG. 5).

12 Claims, 5 Drawing Sheets

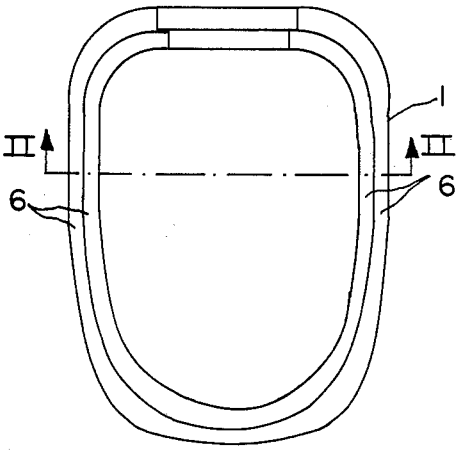
Fig. 1
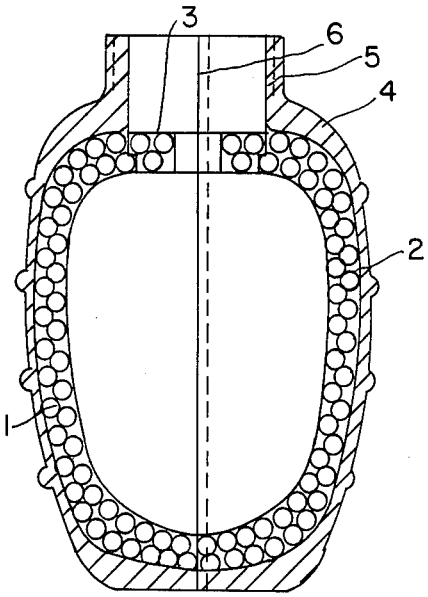
Fig. 4
Fig. 2
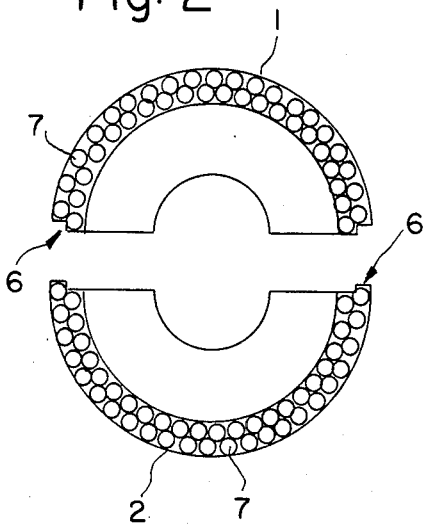
Fig. 3
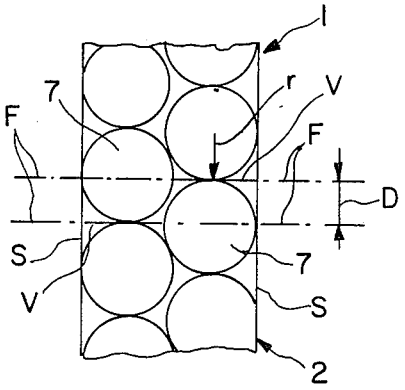
Fig. 5

GRENADE BODY, IN PARTICULAR FOR HAND GRENADES

BACKGROUND OF THE INVENTION

The invention relates to a grenade body, in particular for hand grenades, comprising a multi-part fragmentation body which in all embodiments includes a hollow body and which comprises metal particles embedded in plastics material, and preferably an outer casing of plastics material, which at least partially encloses the fragmentation body, wherein the pieces of the fragmentation body engage positively one into the other at the connecting surfaces.

In order to provide maximum uniformity of distribution of the fragmentation effect when using a grenade, in particular a hand grenade, it is necessary for the fragmentation body to enclose as fully as possible the space inside the grenade or hand grenade, which is filled with explosive. However, that requirement is in conflict with the fact that the fragmentation body must be provided, in at least one location, with an opening which is used on the one hand for introducing or inserting the explosive. On the other hand, parts of the fuse, for example the fuse tube in the case of hand grenades, also project through that opening from the fuse head into the space within the fragmentation body.

In order to achieve maximum enclosure of the explosive charge, it has already been proposed (AT-A No. 348898) that the fragmentation body should be of a multi-part construction; that arrangement comprises an upwardly open cup-shaped hollow body whose wall includes metal particles embedded in plastics material wherein, after the explosive charge has been inserted, a two-part cover also comprising metal particles embedded in plastics material is fitted on to the hollow body and secured in position by a bayonet-type connection. The cover leaves free an opening which is substantially smaller than the opening of the cup-shaped hollow body and into which the fuse head can be fitted, with a screwthreaded portion. In such constructions there is the danger that, upon detonation of the explosive, the individual separate pieces making up the fragmentation body, or at least the cover thereof, may fly away without in turn being broken up into the individual metal particles, and will thus form larger undesirable fragmentation units and prevent uniform fragmentation distribution around the grenade.

Multi-part fragmentation bodies which all told form a hollow body are also known in which shell-shaped portions are connected by means of interengaging grooves and projections, whereupon the fragmentation body formed in that way is encased by an outer casing of plastics material (AT-A No. 240218). Apart from the relatively large opening in those known fragmentation bodies, that arrangement suffers from a lack of metal particles along the connecting surfaces of the shell-like portions in the region of the grooves and projections formed at those locations, and that consequently gives a corresponding area with a reduced fragmentation effect.

The problem of the present invention, in a multi-part fragmentation body which includes a hollow body, is to provide for fragmentation distribution which is a uniform as possible around the grenade, and to improve the uniformity of scatter of the metal particles arranged in the fragmentation body.

SUMMARY OF THE INVENTION

In accordance with the invention the preferably substantially spherical metal particles, in the assembled fragmentation body, have a distance beyond the connecting surface which is smaller than the particle diameter and is preferably equal to or smaller than half the particle diameter, and at least in the region of the connecting surfaces, at least one inner layer of particles is displaced with respect to at least one outer layer of particles by approximately half a particle diameter.

While, in the previously known hand grenades of the kind set forth in the opening part of this specification, no attention was paid to the arrangement of the metal particles in the region of the connecting surfaces between the individual pieces of the fragmentation body, and that therefore resulted, in those connecting regions, in a lack of metal particles in comparison with the other regions of the fragmentation body, which resulted in a certain degree of irregularity in fragmentation distribution, the invention provides that metal particles are also arranged in the regions of the connectng surfaces, more specifically in a manner which guarantees maximum uniformity of fragmentation distribution upon detonation of the explosive charge.

The connecting surfaces between the individual pieces of the fragmentation body may be for example of a step-like configuration or may be of a configuration like a groove and a tongue. In that connection it is advantageous for the notional extension of the connecting surface regions which are disposed transversely with respect to the surface of the fragmentation body to represent a geometrical surface which in one of the two parts of the fragmentation body which are to be connected together, cuts a plurality of metal particles which are preferably arranged in a row along the connecting surface.

In a preferred aspect, the grenade uses at least approximately spherical metal particles of substantially the same size, which are arranged in an almost compactly packed manner in the parts of the fragmentation body. In that case the basic concept of the invention can best be carried into effect by the connecting surfaces which extend transversely with respect to the surface of the fragmentation body having at least two portions which are displaced relative to each other by a distance which approximately corresponds to the radius of the metal particles or an odd multiple of that radius.

The metal particles which, as stated, are preferably spherical, are usually made from steel. In the parts of the fragmentation body, the metal particles are embedded in plastics material, for example polystyrene. The parts of the fragmentation body can be produced in an injection molding tool, the metal particles being introduced into the tool cavity whereupon the plastics material is injected in liquid form and under pressure.

The individual parts of the fragmentation body may best be joined together by adhesive. Additionally, it is possible for the assembled parts of the fragmentation body to have a common casing of plastics material, preferably tough resilient plastics material for example polyethylene, cast therearound, in the usual fashion. Once again that can best be done in an injection moulding tool, the assembled parts of the fragmentation body being fitted as a core into the cavity in the tool.

In the case of fragmentation bodies which have at least one opening on to which a cover which is possibly provided with a smaller opening and which comprises metal particles embedded in plastics material can be fitted, preferably after the explosive has been fitted into the fragmentation body, the problem which also more particularly arises is that, upon detonation of the explosive, the cover is flung off as a whole.

In order to prevent that from occurring, a special feature of the invention provides that the side wall of the cover has at least one stepping from the outside to the space inside the fragmentation body and that the imaginary geometrical surface which extends from the inner annular gap between the cover and the hollow body and which follows the peripheral side wall of the inner step of the cover and which is extended outwardly beyond the same cuts, in the outer region of the cover, a plurality of metal particles, preferably an annular row thereof.

It has been found that this arrangement can prevent the cover of the fragmentation body from being flung away in unfragmented form like a plug, but on the contrary, upon detonation of the explosive, the metal particles are released from their embedded position and individually flung out, including those in the cover of the fragmentation body. A plug formation phenomenon may occur in particular when there are formed in the fragmentation body peripherally closed areas whose peripheral boundary is formed by spaces or cavities between metal particles, and that configuration extends continuously from the inside surface to the outside surface of the fragmentation body. In the case of a one-piece fragmentation body, such plugs do not normally occur at all because the metal particles are irregularly distributed in the course of manufacture in the mold cavity and the metal particles are disposed in two or more layers, in displaced relationship from the inside in an outward direction. When however the fragmentation body is made up of a hollow body and a cover, then a fragment-free zone is formed along the inner annular gap between the cover and the hollow body. If now that fragment-free annular zone were extended 'in a straight line' to the outside wall surface, then that would give the necessary conditions for the above-mentioned phenomenon of a plug being formed, with the harmful effects thereof. The feature in accordance with the invention counteracts that effect in practical terms by deliberate displacement of the outer metal particles relative to the inner metal particles in the cover. If the feature according to the invention is used, then it will usually automatically occur that the imaginary geometrical surface which extends from the outer annular gap between the cover and the hollow body and which follows the peripheral side wall of the outer step of the cover and which is extended inwardly therebeyond cuts a plurality and preferably an annular row of metal particles in the inner region of the wall of the hollow body which extends around the cover. Otherwise care is preferably intentionally taken to ensure that that condition is fulfilled.

If, as is preferably provided, spherical metal particles of approximately equl size and in a densely packed arrangement are disposed both in the hollow body and in the cover of the fragmentation body, then the concept of the invention may be carried into effect by the lateral spacing between the peripheral side surfaces of the steps of the cover approximately corresponding to the radius of the metal particles or an odd multiple of that radius.

Usually, the hollow body which primarily forms the fragmentation body merely has an opening through which the explosive is introduced and also through which fuse members pass. In that case only one cover is required, which as will be appreciated does not necessarily have to be in one piece but which is desirably in the form of a one-piece annular cover with a small central opening. The explosive is introduced, with the cover open. A fuse member, for example a fuse or firing tube, projects through the small opening in the closed cover into the interior of the hand grenade body. The opening in the cover should be as small as possible and should preferably be of a cross-sectional area which just corresponds to the cross-sectional area of the fuse member or firing tube fitted therein.

BRIEF DESCRIPTION OF THE DRAWINGS

The invention will be described in greater detail hereinafter by means of embodiments, with reference to the drawings in which:

FIG. 1 shows a view of the connecting surface of a part of a fragmentation body for a hand grenade, FIG. 2 is a view in cross-section taken along line II—II in FIG. 1, FIG. 3 is a corresponding view in cross-section of the co-operating portion of the fragmentation body, FIG. 4 shows the finished hand grenade body, the two parts 1, 2 of the fragmentation body being turned through 90° relative to FIGS. 1 to 3, FIG. 5 shows a view in cross-section and on an enlarged scale of two parts of the fragmentation body in the region of the connecting surface.

DESCRIPTION OF THE PREFERRED EMBODIMENTS

Figure 6:
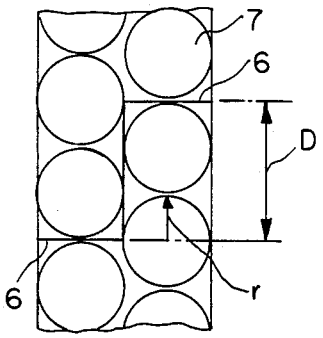
FIGS. 6 to 11 show different alternative embodiments of the connecting regions between the individual parts of the fragmentation body.
Figure 7:
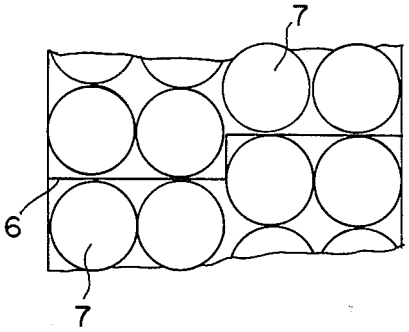
Figure 8:
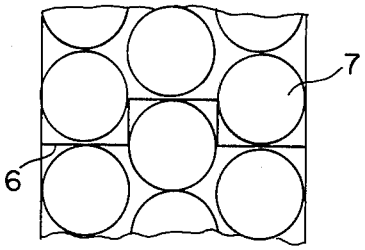
Figure 9:
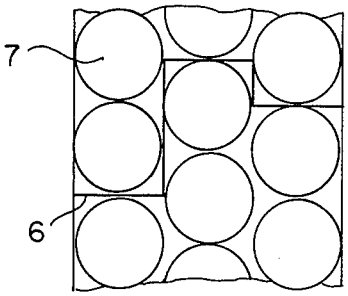
Figure 10:
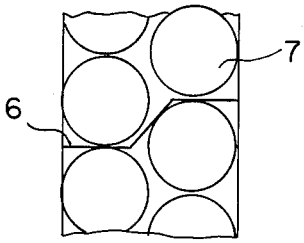

The part 1 of the fragmentation body shown in FIGS. 1 and 2 is of a half-shell configuration and, as can be seen from FIG. 4, is joined to a correspondingly shaped half-shell part 2 of the fragmentation body (see FIG. 3) to make up a substantially egg-shaped hollow body. The two half-shell parts 1 and 2 of the fragmentation body may also be supplemented by an annular part 3 in the region of the opening for the fuse or firing tube to pass therethrough. An outer casing 4 of plastics material is formed or moulded on the fragmentation body or on the two connected half-shell parts 1 and 2, the casing 4 also having a screwthreaded neck 5 on to which the fuse of the hand grenade is screwed.

The two parts 1 and 2 of the fragmentation body have corresponding stepped connecting surfaces 6. The way in which the metal particles 7, which in the present embodiment are spherical, are arranged in the region of the connecting surfaces 6 can be seen in particular from the cross-sectional view on an enlarged scale in FIG. 5. As shown therein, when the fragmentation body is assembled, the metal particles 7 have only a small distance beyond the connecting surface 6 (surface spacing) and the inner layer of the metal particles 7 is displaced relative to the outer layer by approximately half the diameter of the spherical metal particles. In the illustrated embodiment moreover, the imaginary continuation F of the connecting surface regions V which are disposed transversely with respect to the fragmentation body surface S represents a geometrical surface which in one of the two parts of the fragmentation body cuts metal particles which are arranged in a row along the connecting surfaces 6. In addition, with that arrangement of the spherical metal particles, the spacing D of the connecting surface regions V which extend transversely with respect to the fragmentation body surfaces is approximately equal to the radius r of the spherical metal particles 7.

In the embodiment shownin FIG. 6, the distance D is equal to 3r. In general terms, the following relationship applies in respect of the distance D, with a stepped configuration in respect of the connecting surfaces 6 and when using spherical metal particles of approximately equal size:

$$D \cong r(2n+1);\ n \in N$$

Figure 11:
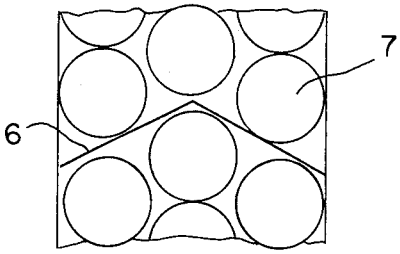

The foregoing equation for the distance D also applies in regard to the embodiments of the connecting surface 6 and the spherical metal particles 7 shown in FIGS. 7 to 10, but not in regard to the embodiment of FIG. 11. However, the embodiment shown in FIG. 11 is also an embodiment given by way of example of the invention because in that construction also, when the fragmentation body is assembled, the distance (surface distance) of the spherical metal particles 7 beyond the connecting surfaces 6 is smaller than the diameter of the spherical particles and in fact is even smaller than the radius of the spherical particles, and because the individual layers of the sperical metal particles are displaced relative to each other by approximately half the sphere diameter.

As can be seen from FIG. 4, the connection between the additional annular part 3 of the fragmentation body and the interconnected half-shell parts 1 and 2 of the fragmentation body is also produced in accordance with the principles of the invention, as will be described in greater detail with reference to FIGS. 12 to 15.

In the embodiment shown in FIGS. 1 to 5, the fragmentation body is divided along its longitudinal axis into two half-shell parts 1 and 2. In principle however the invention may also be used in regard to another manner of dividing the fragmentation body, for example in a situation where the fragmentation body is transversely divided into upper and lower shell-like parts.

Figure 12:
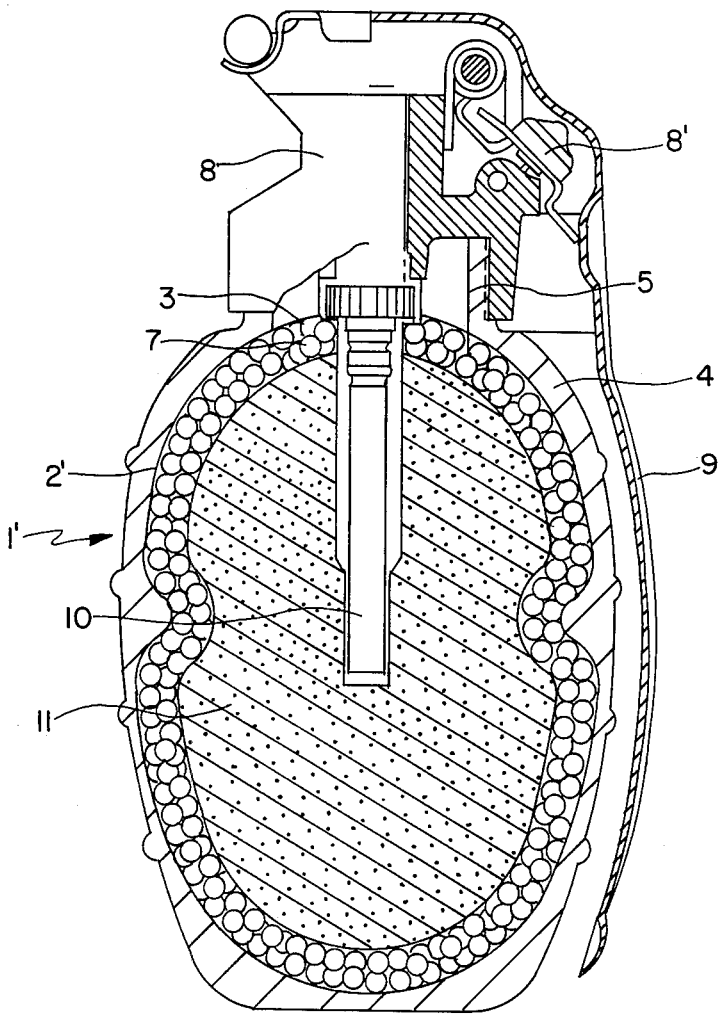
FIG. 12 shows a view in vertical section of a further embodiment of a hand grenade with a fragmentation body according to the invention.
Figure 13:
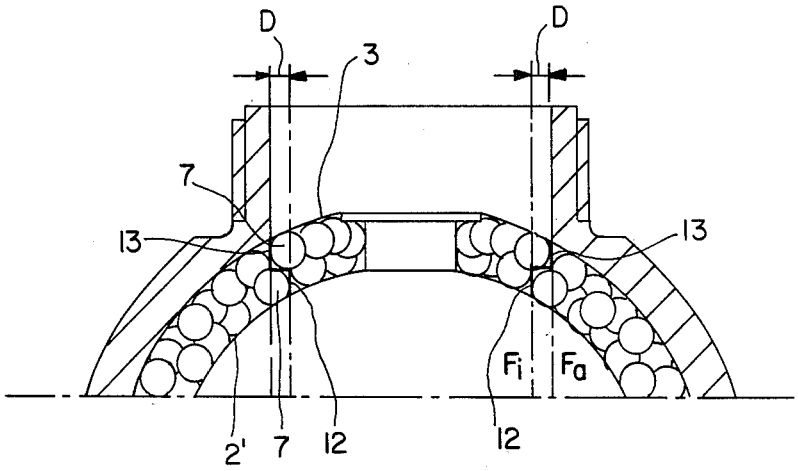
FIG. 13 shows a view on an enlarged scale of a portion of the fragmentation body shown in FIG. 12, in the region of the cover.

The hand grenade shown in FIGS. 12 and 13 also comprises a hand grenade body 1' which consists of an inner fragmentation body 2',3 and an outer casing 4. The outer casing 4 is produced from tough resilient plastics material, for example polyethylene, and has a neck-like projection 5 with a male screwthread. The fragmentation body comprises two parts, a hollow body 2' and a cover 3. Both the wall of the hollow body 2' and the cover 3 comprise metal particles 7 in the form of steel balls, which are embedded in plastics material. The metal particles 7 are arranged in a closely packed array. The plastics material connecting the metal particles may comprise for example polystyrene.

Screwed on to the hand grenade body is a fuse head 8 which carries the usual operating elements such as striker 8', safety lever 9 and firing tube 10. The tube 10 projects through the central opening in the cover 3 into the interior of the hand grenade body, more particularly into a recess in the explosive charge 11 (that also applies moreover to the embodiment shown in FIGS. 1 to 4).

The cover 3 of the fragmentation body is of an annular configuration with a small central opening whose cross-sectional area corresponds to the cross-sectional area of the tube 10. The peripheral side wall of the cover 3 is of a stepped configuration, the outer periphery of the cover 3 being larger than is inner periphery.

The metal particles 7 are arranged in the cover 3 and in the region of the hollow body 2 that is disposed around the cover 3, in such a way that the imaginary geometrical surface $F_I$ (being in the present case a cylindrical surface) which extends from the inner annular gap 12 between the cover 3 and the hollow body 2' and which follows the peripheral side wall of the inner step of the cover 3 and which is extended outwardly therebeyond, in the outer region of the cover 3, cuts a plurality of metal particles which are disposed in an annular arrangement around the axis of the cover (and the hand grenade). In addition, the imaginary geometrical surface $F_A$ (also a cylindrical surface) which extends from the outer annular gap 13 between the cover 3 and the hollow body 2' and which follows the peripheral side wall of the outer step of the cover 3 and which is extended inwardly, in the inner region of the wall of the hollow body 2' which is disposed around the cover 3, cuts a plurality of metal particles which are again arranged in an annular row, relative to the axis of the hand grenade.

The lateral distance D between the peripheral side surfaces of the steps of the cover 3 is approximately equal to the radius r of the metal particles 7.

The hand grenade body is filled with explosive, for example an explosive which is plastic, liquid or powdery in the condition of working therewith (for example Hexogen, Composition B, or Nitropenta) when the cover 3 is open. After the operation of filling the body of the hand grenade with explosive, the cover is closed and preferably glued to the body 2'. Finally, the firing tube 10 is inserted through the small opening in the cover 3 and the fuse head is screwed to the hand grenade body.

Figure 14:
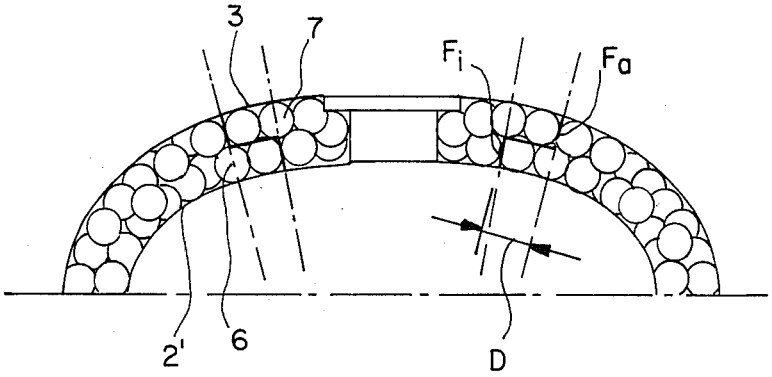
FIG. 14 is an alternative construction to that shown in FIG. 13.

The alternative embodiment shown in FIG. 14 differs from that shown in FIGS. 12 and 13 in that the lateral distance between the peripheral side surfaces of the steps of the cover 3 is greater, more specifically corresponding to three times the radius r of the metal particles 7. Quite generally, in this case also, when using spherical metal particles of approximately equal size in a closely packed arrangement, the lateral distance D between the peripheral side surfaces of the steps of the cover corresponds to an odd multiple of the radius r of the metal particles. Expressed in terms of a formula, that in turn gives the following:

$$D \cong r(2n+1);\ n \in N$$

In the case of the construction shown in FIG. 14, the geometrical surfaces $F_I$, $F_A$ which follow the lateral step surfaces of the cover 3 and which each cut a plurality of metal particles 7 in the cover and in the hollow body 2' respectively are not cylindrical surfaces but conical surfaces.

FIG. 14 only shows the fragmentation body 2' and 3 and not also an outer casing of plastics material which, as will be appreciated, is usually provided although not necessarily so.

The embodiment shown in FIG. 15 once again comprises a hand grenade having a fragmentation body consisting of a hollow body 2' and a cover 3, wherein metal particles, preferably steel balls, which are embedded in plastics material and which are in a closely packed array are disposed both in the wall of the hollow body and also in the cover 3. The cover 3 has a central opening for the firing tube 10 to pass therethrough. The hollow body 2' has a cylindrical cavity and therefore, when the cover 3 is in the open condition, is suitable for accommodating a preshaped pressing of a solid explosive 11.

The cover which is fitted into position after the operation of introducing the explosive 11 is held down by parts of the fuse head 8 which is screwed on to the grenade, but it may also be additionally glued to the wall of the hollow body 2'.

Figure 15:
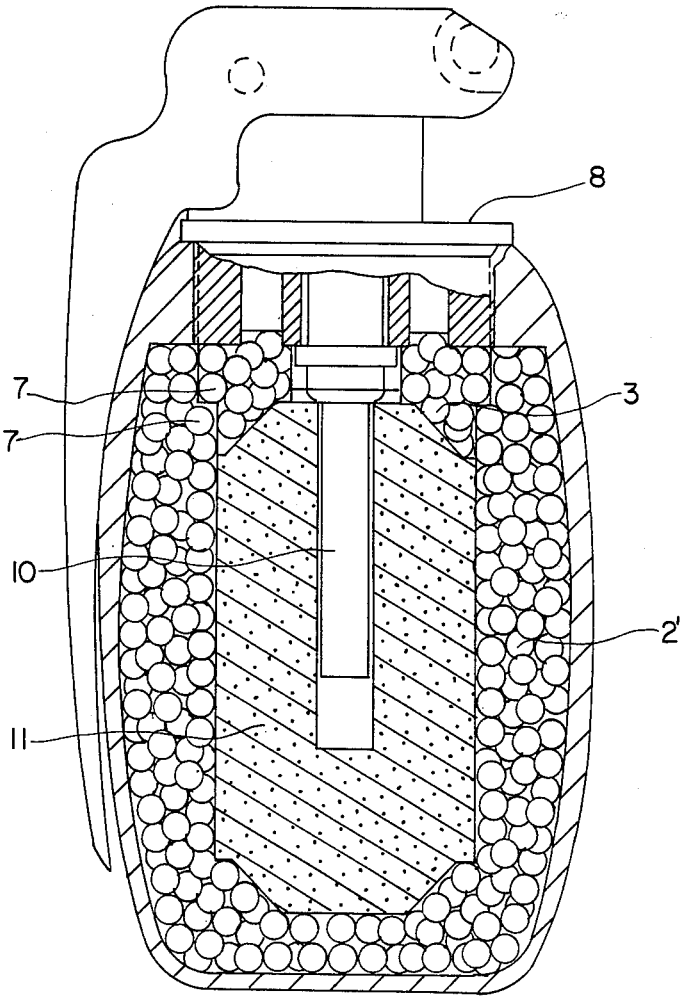
FIG. 15 is a view in vertical section of a hand grenade with a further embodiment of a fragmentation body according to the invention.

The conditions in accordance with the invention in regard to the arrangement of the metal particles in the cover 3 and in the regions of the hollow body 2' around the cover also apply in the construction shown in FIG. 15, more specifically in relation to the peripheral side surfaces of the two steps of the cover 3, whereby the imaginary extension of the inner annular gap 12 between the cover 3 and the hollow body 2', in an outward direction, meets metal particles 7 and not just spaces between metal particles, in the outer region of the cover 3. Likewise, the imaginary extension in an inward direction of the outer annular gap 13 between the cover 3 and the hollow body 2' meets metal particles 7 and not just spaces between metal particles, in the inner region of the wall of the hollow body 2 which is disposed around the cover 3.

In the illustrated embodiments, the side surfaces of the cover 3 are of a two-step configuration, but configurations of the cover 3 that provide three or more steps are also possible in accordance with the invention. Furthermore, the fragmentation body may also be provided with a second cover, more particularly at the bottom of the fragmentation body which is in opposite relationship to the fuse head, if the explosive is to be introduced into the fragmentation body from that location. However the second cover mentioned does not have a central hole.

When reference is made in the present description and in the claims to a 'multi-part' fragmentation body, that is also intended to embrace a two-part fragmentation body, as can be seen from FIGS. 12 and 15.

I claim:

1. A grenade body comprising a multi-part fragmentation body which includes a hollow body and substantially spherical metal particles embedded in plastics material, and preferably an outer casing of plastics material which at least partially encloses the fragmentation body, wherein parts of the fragmentation body positively engage one into the other at connecting surfaces of the parts, characterised in that the substantially spherical metal particles, when the fragmentation body is assembled, have a distance beyond the connecting surface which is smaller than the particle diameter and that at least in the region of the connecting surfaces at least one inner layer of particles is displaced relative to at least one outer layer of particles by approximately a half particle diameter.

2. A grenade body according to claim 1 wherein an imaginary continuation of the connecting surface regions which are disposed transversely with respect to the fragmentation body surface represents a geometrical surface which in one of the two parts of the fragmentation body that are to be connected, cuts a plurality of particles which are preferably arranged in a row along the connecting surface.

3. A grenade body according to claim 1 wherein the connecting surfaces which extend transversely with respect to the fragmentation body surface have at least two portions which are displaced relative to each other by a distance which corresponds to the radius of the spherical metal particles.

4. A grenade body according to claim 1 comprising a fragmentation body which forms a hollow body and whose wall comprises metal particles embedded in plastics material and has at least one opening on to which a cover is fitted which includes metal particles embedded in plastics material, characterised in that the side wall of the cover has at least one step from the outward side to the space inside the fragmentation body, and that an imaginary geometrical surface which extens from an inner annular gap between the cover and the hollow body and which follows the peripheral side wall of an inner step of the cover and which is extended outwardly beyond the same cuts, in the outer region of the cover, a plurality and preferably an annular row of metal particles.

5. A grenade body according to claim 4 wherein an imaginary geometrical surface which extends from an outer annular gap between the cover and the hollow body and which follows the peripheral side wall of the outer step of the cover and which is extended inwardly beyond the same cuts, in the inner region of the wall of the hollow body around the cover, a plurality and preferably an annular row of metal particles.

6. A grenade body according to claim 4 wherein substantially spherical metal particles of substantially the same size and in a closely packed arrangement are disposed both in the hollow body and also in the cover, and wherein the lateral distance between the peripheral side surfaces of the steps of the cover approximately corresponds to the radius of the metal particles.

7. A grenade body according to claim 4 wherein said cover is provided with an opening.

8. A grenade body according to claim 7 wherein the cross section of the opening in the cover corresponds to the cross-section of a firing tube.

9. A grenade body according to claim 1 wherein when the fragmentation body is assembled, the substantially spherical metal particles have a distance beyond the connecting surface that is equal to or smaller than half the particle diameter.

10. A grenade body according to claim 1 wherein the connecting surfaces which extend transversely with respect to the fragmentation body surface have at least two portions which are displaced relative to each other by a distance which corresponds to an odd multiple of the radius of the spherical metal particles.

11. A grenade body according to claim 4 wherein substantially spherical metal particles of substantially the same size and in a closely packed arrangement are disposed both in the hollow body and also in the cover, and wherein the lateral distance between these peripheral side surfaces of the steps of the cover approximately corresponds to an odd multiple of the radius of the metal particles.

12. A grenade body according to claim 4 wherein said cover is fitted over said at least one opening after the operation of introducing the explosive.

* * * * *